US010605451B2

(12) United States Patent
Dreizler et al.

(10) Patent No.: US 10,605,451 B2
(45) Date of Patent: Mar. 31, 2020

(54) SURFACE COMBUSTION BURNER

(71) Applicant: Ulrich Dreizler, Hausen ob Verena (DE)

(72) Inventors: Ulrich Dreizler, Hausen ob Verena (DE); Daniel Dreizler, Balgheim (DE)

(73) Assignee: Ulrich Dreizler, Hausen ob Verena (DE)

( * ) Notice: Subject to any disclaimer, the term of this patent is extended or adjusted under 35 U.S.C. 154(b) by 1063 days.

(21) Appl. No.: 14/412,863

(22) PCT Filed: May 15, 2013

(86) PCT No.: PCT/EP2013/060033

§ 371 (c)(1),
(2) Date: Jan. 5, 2015

(87) PCT Pub. No.: WO2014/005751

PCT Pub. Date: Jan. 9, 2014

(65) Prior Publication Data

US 2015/0192292 A1 Jul. 9, 2015

(30) Foreign Application Priority Data

Jul. 3, 2012 (DE) ..... 20 2012 102 437 U

(51) Int. Cl.
*F23D 14/14* (2006.01)
*F23D 14/58* (2006.01)
(Continued)

(52) U.S. Cl.
CPC ..... *F23D 14/145* (2013.01); *F23D 14/02* (2013.01); *F23D 14/34* (2013.01); *F23D 14/58* (2013.01);
(Continued)

(58) Field of Classification Search
None
See application file for complete search history.

(56) References Cited

U.S. PATENT DOCUMENTS 3,204,683 A * 9/1965 Ruff ..... F23C 99/00 126/92 B
3,324,924 A * 6/1967 Hailstone ..... F23C 99/00 431/328

(Continued)

FOREIGN PATENT DOCUMENTS

DE 197 18 532 A1 5/1997
DE 197 24 806 A1 6/1997

(Continued)

OTHER PUBLICATIONS

Machine translation EP2687781, file "EP2687781 wipo translate. pdf".*

(Continued)

*Primary Examiner* — Avinash A Savani
*Assistant Examiner* — Martha M Becton
(74) *Attorney, Agent, or Firm* — Renner, Otto, Boisselle & Sklar, LLP

(57) ABSTRACT

The invention relates to a burner with surface burning, which comprises a burner head (12) having a housing (14), which has a supply (18) for a fuel-air mixture upstream and has a fabric membrane (16) downstream on an outlet side and comprises a flame flash-back barrier (17), which is arranged upstream of the fabric membrane (16) at a distance to this, wherein at least the fabric membrane (16) and the flame flash-back barrier (17) are arranged by at least one releasable connection element (54) which engages with a receiving region (47) in the housing (14).

22 Claims, 5 Drawing Sheets

Figure 1:
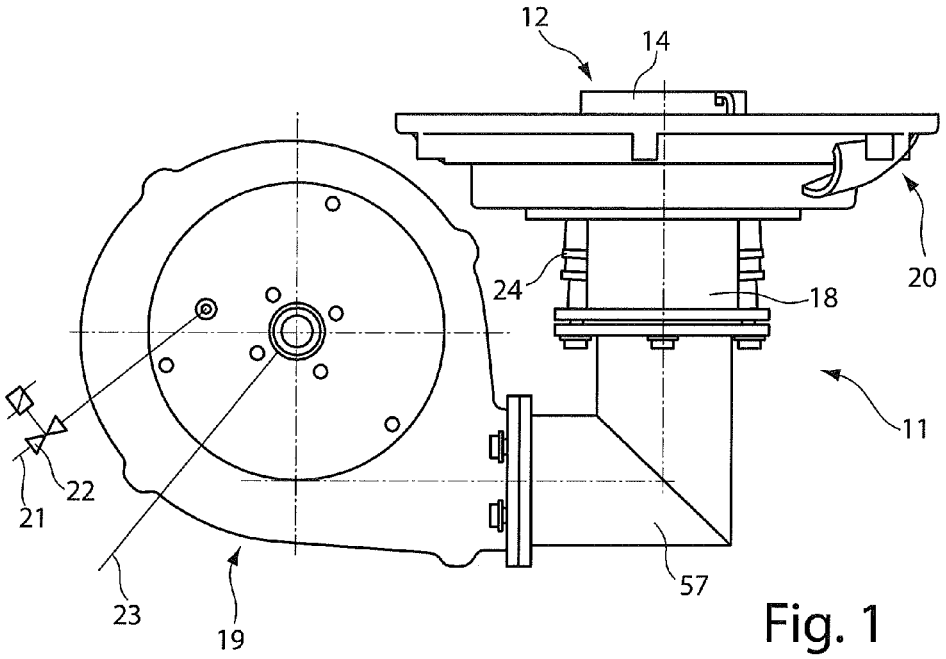

(51) Int. Cl.
*F23D 14/82* (2006.01)
*F23D 14/34* (2006.01)
*F23D 14/02* (2006.01)

(52) U.S. Cl.
CPC ..... *F23D 14/82* (2013.01); *F23D 2213/00* (2013.01); *F23D 2900/00003* (2013.01); *F23D 2900/00019* (2013.01)

(56) References Cited

U.S. PATENT DOCUMENTS 3,407,025 A * 10/1968 Hardison ..... F23C 99/00 431/329
3,445,175 A * 5/1969 Kurt ..... F23D 14/14 431/328
3,472,601 A * 10/1969 Kazuo ..... F23D 14/12 431/328
3,488,137 A * 1/1970 Hikaru ..... F23D 14/145 431/329
3,601,320 A * 8/1971 Plessis ..... A01G 25/023 138/114
3,718,321 A * 2/1973 Alms ..... F23D 14/34 431/263
4,480,988 A * 11/1984 Okabayashi ..... F24H 1/145 126/92 R
4,597,734 A * 7/1986 McCausland ..... B22F 3/002 126/92 AC
4,657,506 A * 4/1987 Ihlenfield ..... F23D 14/145 126/92 R
4,752,213 A * 6/1988 Grochowski ..... F23D 14/02 431/328
4,846,716 A * 7/1989 Courrege ..... F23D 14/08 431/263
4,878,837 A * 11/1989 Otto ..... C04B 38/067 126/91 A
5,017,129 A * 5/1991 Velie ..... F23D 14/58 126/92 AC
5,137,583 A * 8/1992 Parent ..... F23D 14/12 136/253
5,240,411 A * 8/1993 Abalos ..... F23D 14/145 126/92 AC
5,326,257 A * 7/1994 Taylor ..... F23D 14/14 431/329
5,360,490 A * 11/1994 Nelson ..... F23D 14/12 136/253
5,439,372 A 8/1995 Duret et al.
5,441,402 A * 8/1995 Reuther ..... F23D 14/02 431/328
5,458,484 A * 10/1995 Ripka ..... F23D 14/58 126/109
5,511,974 A * 4/1996 Gordon ..... F23D 14/02 431/328
5,520,536 A * 5/1996 Rodgers ..... F23D 14/02 126/116 R
5,580,238 A * 12/1996 Charles, Sr. ..... F23D 14/70 126/91 A
5,686,368 A * 11/1997 Wong ..... C04B 35/50 252/492
5,704,777 A * 1/1998 Measom ..... F23D 14/065 126/39 J
5,711,661 A * 1/1998 Kushch ..... F23D 14/12 431/326
5,839,891 A * 11/1998 Cook ..... F23D 14/02 431/7
5,989,013 A * 11/1999 Gray ..... F23D 14/14 126/92 AC
5,993,192 A * 11/1999 Schmidt ..... F23D 14/18 431/12
6,007,329 A * 12/1999 Meyer ..... F23D 14/14 431/326
6,059,566 A * 5/2000 Cummings, III ..... F23D 14/02 239/434
6,238,206 B1 * 5/2001 Cummings, III ..... F23D 14/24 431/10
6,349,714 B1 * 2/2002 Hurley ..... F24C 3/103 126/21 R
6,896,512 B2 * 5/2005 Rattner ..... F23D 14/16 126/91 R
7,038,227 B2 * 5/2006 Aust ..... F23D 14/14 250/493.1
7,052,273 B2 * 5/2006 Sehmbi ..... F23D 14/105 239/553.3
7,493,876 B2 * 2/2009 Strempek ..... F22B 21/341 122/4 D
7,726,967 B2 6/2010 Best
7,913,683 B2 * 3/2011 Schwank ..... F23C 3/002 126/104 A
8,814,560 B2 * 8/2014 Le Mer ..... F23D 14/70 431/12
9,182,119 B2 * 11/2015 Mach ..... F23D 14/145
9,291,346 B2 * 3/2016 Lenoir ..... F23D 14/14
2006/0292510 A1 * 12/2006 Krauklis ..... F23D 14/145 431/326
2008/0178860 A1 * 7/2008 Schwank ..... F23C 3/002 126/104 A
2008/0241776 A1 10/2008 Burtea et al.
2010/0316965 A1 * 12/2010 Le Mer ..... F23D 14/70 431/12
2015/0192292 A1 * 7/2015 Dreizler ..... F23D 14/34 431/329

FOREIGN PATENT DOCUMENTS

DE 10 2009 028 624 A1 8/2009
DE 10 2009 025 593 A1 12/2010
DE 102012014009 A1 * 7/2012
EP 0 223 691 A1 5/1987
EP 0875717 A1 11/1998
EP 0 949 452 A2 10/1999
EP 1 039 219 A1 9/2000
EP 1 918 640 A2 5/2008
GB 907 061 A 1/1961
JP H08-42815 A 2/1996
WO 2004/042141 A1 5/2004

OTHER PUBLICATIONS

JP-08042815-A, inventor Kushch, Aleksandr S, English abstract and figures attached as "JP08042815_abstract_and_FIGs.pdf" (Year: 1996).*
International Search Report and Written Opinion for corresponding patent application No. PCT/EP2013/060033 dated Jan. 15, 2014.
International Preliminary Report on Patentability for corresponding patent application No. PCT/EP2013/060033 dated Aug. 26, 2014.

* cited by examiner

SURFACE COMBUSTION BURNER

The invention relates to a burner with surface burning, which has a fabric membrane on a housing on the burner side and comprises a flame flash-back barrier upstream of a burner side.

Figure 2:
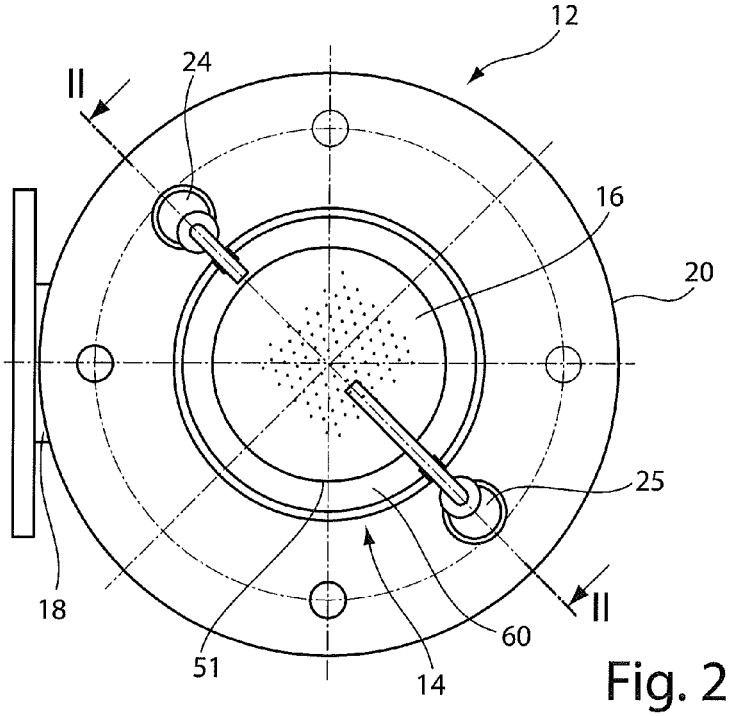

Such a burner is known from EP 0 628 146 B1. Such a gas burner has a fabric membrane on an outlet side of the housing which is formed as a gas-permeable metal fibre plate. This metal fibre plate is porous and additionally comprises through-holes which are arranged at regular distances to one another and form a hole pattern. The metal fibre plate is allocated to a distribution component in the housing. A fuel-air mixture is introduced into the housing via a supply line and flows through the distribution component, such that a flame field is formed after the through-holes in the metal fibre plate outlet are flowed through, said flame field having higher flames which are caused by a regular pattern of these through-holes. Such housings are, for example, formed to be square, as is depicted in FIGS. 1 and 2 of EP 0 628 146 B1. To fix the distribution component to the flame flash-back barrier, the metal fibre plate and the distribution component are applied to a front-side edge of the housing in order to subsequently put a clamping ring having a circulating shoulder over this, wherein this clamping ring is connected firmly to the housing with a welded joint.

A burner with surface burning emerges from EP 0 223 691 A1, in which a ceramic plate is fixed to a housing of burner by means of flange, wherein the flange engages with an outer periphery of the tubular housing. This flange is connected firmly to the tubular housing by a rivet, such that the burner plate is fixed unreleasably to the housing.

Such burners have the disadvantage that, in the case of damage to the fabric membrane and/or the distribution component, the entire burner must be replaced. Additionally, an alignment of a hole pattern of the fabric membrane with a hole pattern of the distribution component cannot occur.

The object of the invention is to propose a burner for surface burning in which cost-efficient maintenance is enabled and, on installation of a fabric membrane as well as a flame flash-back barrier, an alignment of the two parts with each other is enabled.

This object is solved by a burner with surface burning in which the fabric membrane and the flame flash-back barrier are able to be arranged in the housing using at least one releasable connection element which engages with a receiving space. Due to this releasable connection element, the fabric membrane and the flame flash-back barrier can be removed from the housing for replacement, such that, subsequently, the housing is equipped with a new flame flash-back barrier and/or fabric membrane. The fabric membrane can be removed for maintenance purposes. In the case of damage, the entire burner does not have to be exchanged. Additionally, the at least one releasable connection element, which is able to be arranged on or fixed to the housing, has the advantage that an alignment of a hole pattern of through-holes in the fabric membrane with a hole pattern of through-bores in the flame flash-back barrier is enabled before fixing the releasable connection element in the housing and thus before fixing the fabric membrane and the flame flash-back barrier to each other.

The housing of the burner can be formed to be tubular and can comprise a receiving region having an inner peripheral surface, with which at least the fabric membrane and/or the flame flash-back barrier are guided radially or laterally. Thus, a simple alignment to each other and adjustment can be enabled after the insertion of the flame flash-back barrier and/or the fabric membrane, solely by a rotational movement of the flame flash-back barrier.

At least the fabric membrane and/or the flame flash-back barrier are able to be adjusted in their position with respect to each other or in the alignment of the hole patterns and are held in a braced manner by the releasable connection element. Thus, the aligned or adjusted position of the fabric membrane with respect to the flame flash-back barrier relative to the respective hole patterns thereof are fixed inside the housing in a simple way.

Astonishingly, it has been shown that, for example, in the case of an aligned arrangement of the through-bores of the flame flash-back barrier with the through-holes of the fabric membrane, an optimised flame matrix can be formed. Such a flame matrix consists of individual flames and a support flame, wherein the individual flames protrude from the support flame. Due to the aligned arrangement, a good flow cooling of the fabric membrane and at the same time a cooling of the flame root of the individual flames are enabled. Thus an increased surface loading of the fabric membrane can be achieved, which means that an increase in performance is provided with respect to previous burner performances.

Furthermore, due to this arrangement it is enabled that the hole pattern of the fabric membrane is able to be positioned in a twisted and/or displaced arrangement with respect to the hole pattern of the flame flash-back barrier. Thus so-called flame nests can be formed. "Flames nests" are understood to be a group of individual flames within a flame matrix which are not all aligned in parallel to one another and extend at a right angle to the surface of the fabric membrane into the combustion chamber, but rather at least one central main flame is directed as an individual flame into the combustion chamber and this comprises several surrounding individual flames which are inclined with respect to this at a deflection angle to the main flame. Thus a detuning, i.e. a reduction of occurring resonances, can be achieved, whereby noise reduction is achieved for the surface burning. Due to the releasable connection element, an adaptation and adjustment of the fabric membrane with respect to the flame flash-back barrier or vice versa can thus be carried out directly on site for a least one particularly specific environmental condition.

A pre-determined distance is preferably generated by a spacer element between the fabric membrane and the flame flash-back barrier, such that a free flow chamber of the fuel-air mixture results between the flame flash-back barrier and the fabric membrane. This spacer element preferably has the same outer periphery as the fabric membrane and/or the flame flash-back barrier, such that these components are able to be inserted together and one after another into the receiving region of the housing and therein are guided radially. The spacer element can, for example, be formed as a heat-resistant ring which preferably has contact surfaces aligned axially on both sides.

According to one preferred embodiment of the burner, the at least one releasable connection element is provided upstream of the flame flash-back barrier. This arrangement has the advantage that the releasable connection element is on the so-called "cold side", i.e. the flame flash-back barrier is not on the burner side, but rather on the supply side. The fuel-air mixture is supplied on the supply side and achieves cooling due to the flow, such that a long service life is achieved for the releasable connection element.

The receiving region can be limited downstream by an annular shoulder pointing towards the longitudinal central axis of the housing and upstream by the releasable connection. This enables a simple insertion of the fabric membrane and subsequently of the flame flash-back barrier into the burner housing from behind. Subsequently, after the insertion and alignment of the fabric membrane and the flame flash-back barrier, the releasable connection element can be fixed. This represents a constructively simple and cost-efficient design of the burner head.

One alternative embodiment for the formation of the releasable connection element can represent the formation of a screw connection between a flame tube and a burner housing. According to a first embodiment, the fabric membrane and the flame flash-back barrier are held in a clamped manner in the receiving space of the burner housing between the burner housing and the flame tube.

One advantageous embodiment of the screw connection can provide that the burner housing and the flame tube are connected to each other by the screw connection and the flame tube preferably has an external thread and the burner housing an internal thread. Thus, a front-side end of the burner housing can form a contact surface for the flame flash-back barrier and at least the fabric membrane and the flame flash-back barrier can be clamped in between these by screwing the flame tube to the shoulder arranged thereon on the burner housing.

Due to an elongation as a spacer, preferably having an internal and external thread, the burner housing can be elongated by any amount, wherein the elongation is positioned between the burner housing and the flame tube.

One alternative embodiment of the releasable connection is provided in that the fabric membrane and, if necessary, also a spacer element are received in a clamped manner and a further releasable connection element is provided upstream of the screw connection, with which the flame flash-back barrier is fixed. This further releasable securing element can be formed as a circlip or clamping ring which is inserted into a circulating groove in the burner housing.

One further alternative embodiment of the burner provides that the releasable connection element is able to be arranged upstream and downstream of the receiving region. This arrangement enables the use of a tube as a housing, whereby a cost-efficient design for larger flame tube diameters of over 300 mm is enabled.

Alternatively, the housing can be formed in the tubular housing for the formation of the receiving region upstream of the receiving space by a circulating beading which is directed towards the central axis. In this embodiment, prefabricated tubes can be used as the housing, in which a beading is introduced in a simple way by a rolling process in order to limit the receiving region upstream.

In the case of the housing formed from a tube in a circulating beading, an inner clamping ring is preferably provided for fixing the flame flash-back barrier and the fabric membrane as well as the spacer element, said inner clamping ring preferably being arranged therebetween, said inner clamping ring enabling a clamping fixing in the tube without additional processing of the inner peripheral surface. Alternatively, provision can furthermore be made for two tube sections which are placed one inside the other to form the housing, wherein the tube sections are preferably connected firmly to each other and an inner tube section forms a shoulder.

The tubular housing into which a beading can be introduced preferably consists of a drawn or welded tube.

Preferably, for the production of the housing, a heat-resistant material, in particular a steel, stainless steel or grey cast iron, can be used as a rotating part. For a so-called wet operation, stainless steel is used, whereas for a dry operation both steel and grey cast iron can be used.

The releasable connection element can be formed according to a first cost-efficient embodiment as a circlip which is able to be inserted into a circulating groove in the inner peripheral surface of the receiving region on the housing. Such circlips or snap rings can be formed from heat-resistant material and can be assembled and disassembled simply.

One alternative embodiment for a releasable connection element is provided by an inner clamping ring, which is braced against the inner peripheral surface of the receiving region by radial expansion. Such inner clamping rings or clamping clips enable a fixing without additional processing of the inner peripheral surface.

The housing having the shoulder which points inwards is preferably formed as a rotating part according to a first embodiment. Thus a cost-efficient production of a one, two or multi-part housing can be provided.

One further preferred embodiment of the burner provides that at least one ignition electrode and at least one monitoring electrode are fixed on an outer side of the housing, the electrode tips of which extend into a flame matrix formed downstream on the fabric membrane or adjacently to this. In particular in the case of smaller burner housings, ignition and monitoring from outside is provided.

Alternatively, in the case of burners having a larger flame matrix, it can be provided that the at least one ignition electrode and/or at least one monitoring electrode, which are preferably received by a mutual electrode holder, are able to be fixed in a through-opening in the fabric membrane. Thus, an interior positioning of the at least one ignition electrode and/or monitoring electrode can be provided. This additionally has the advantage that, in the case of large surfaces of the fabric membrane, an additional fixing of the fabric membrane is enabled in order to receive this fabric membrane with little or no oscillation.

The burner according to the features described above is preferably used as a flat burner, meaning that the surface burning occurs adjacently to a combustion chamber without the burner itself substantially protruding into the combustion chamber.

Figure 3:
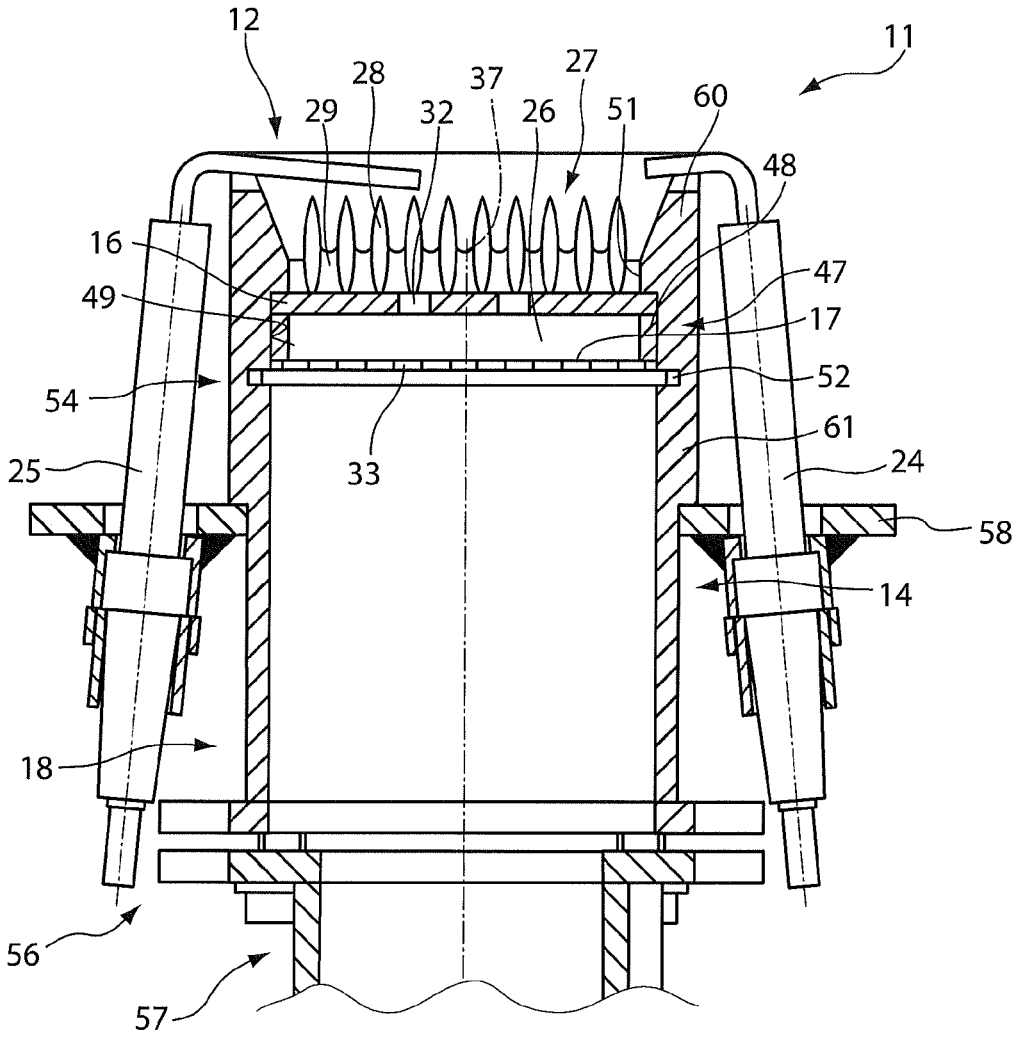
Figure 4:
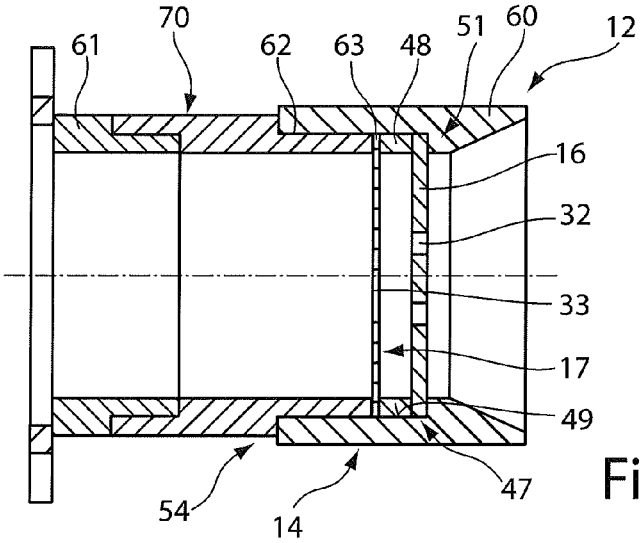
Figure 5:
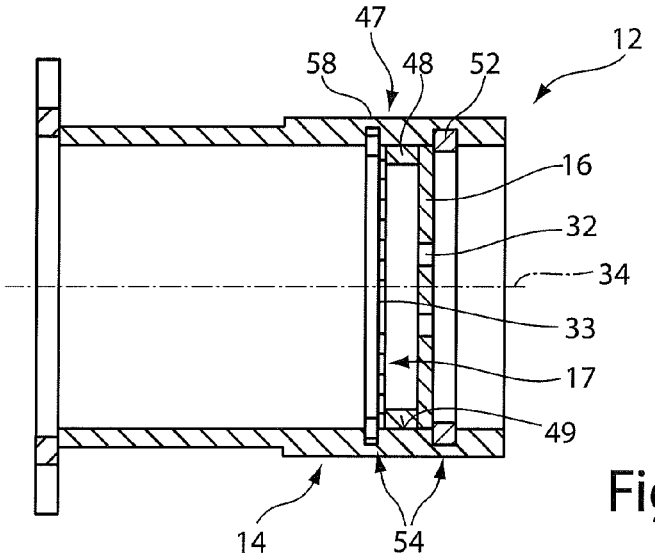
Figure 6:
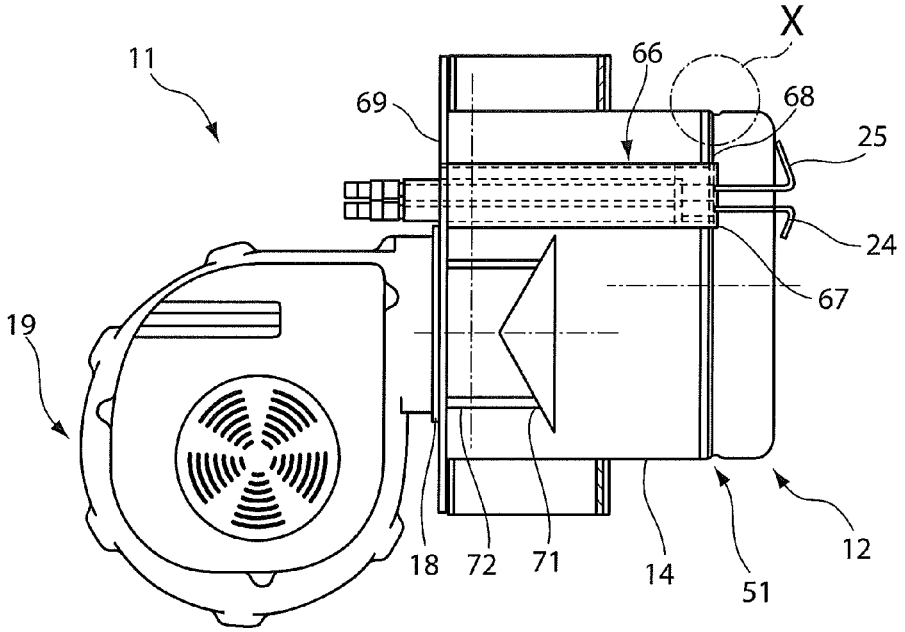
Figure 7:
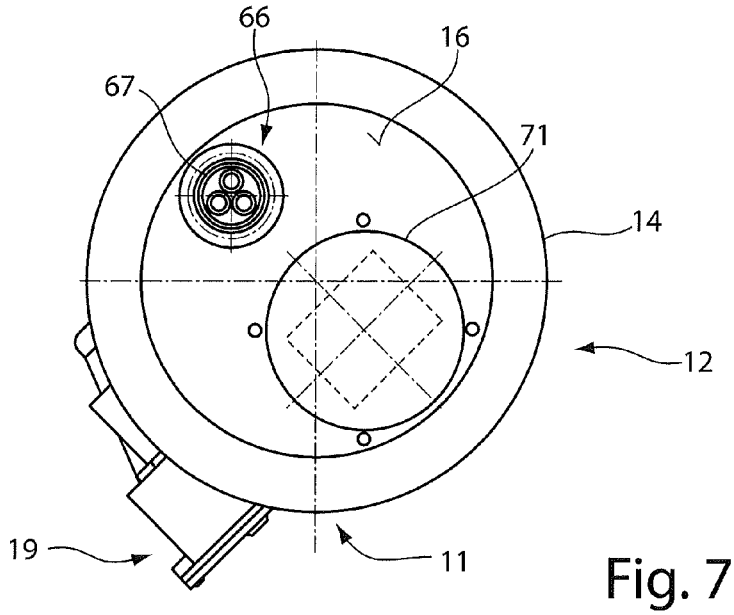
Figure 8:
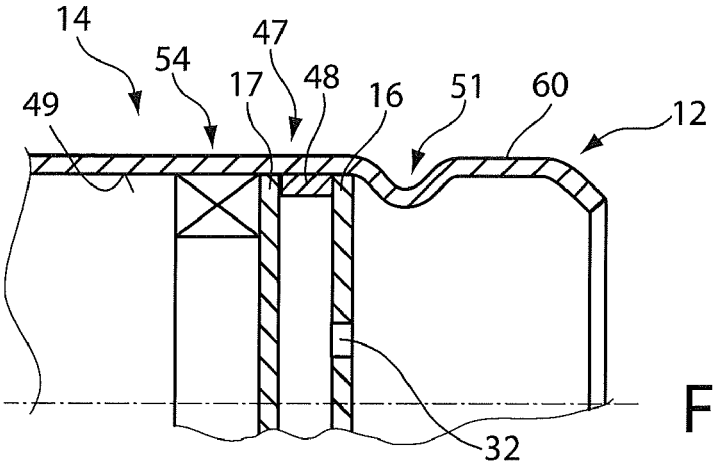
Figure 9:
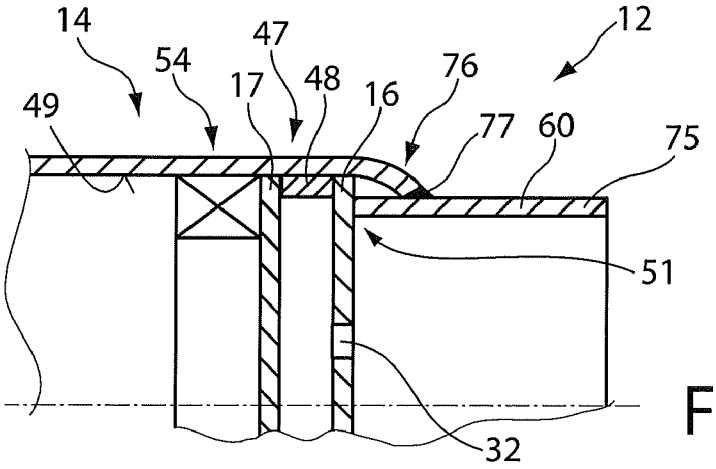

The invention as well as further advantageous embodiments and developments of the same are described and explained in more detail below by means of the examples depicted in the drawings. The features to be gleaned from the description and the drawings can be applied individually or together in any combination according to the invention. Here are shown:

FIG. 1 a schematic side view of a burner according to the invention,

FIG. 2 a schematic view of the burner according to FIG. 1,

FIG. 3 a schematic sectional view of the burner head according to FIG. 1, FIG. 4 a schematic sectional view of an alternative burner head to FIG. 3, FIG. 5 a schematic sectional view of a further alternative embodiment to the burner according to FIG. 4, FIG. 6 a schematic side view of the alternative embodiment of the burner according to FIG. 1, FIG. 7 a schematic top view onto the burner head according to FIG. 6, FIG. 8 a schematic sectional view of the burner head of the burner according to FIG. 6 and FIG. 9 a schematic sectional view of an alternative embodiment of the burner head to FIG. 8.

In FIGS. 1 and 2, a burner 11 having a burner head 12 is depicted schematically. This first embodiment comprises a housing 14 in which a fabric membrane 16 (FIG. 3) is arranged downstream of an outlet side and a flame flash-back barrier 17 (FIG. 3) is arranged at a distance to the fabric membrane 16. A fuel-air mixture is supplied by a fuel supply line 21 via a supply 18 which flows into the housing 14. This supplies a determined quantity of fuel to a fan 19 having an impeller via a magnetic valve 22. At the same time, the supply of air occurs via an air supply line 23. The fuel-air mixture generated by the fan 19 is supplied to the burner head 12 via the supply 18, such that this flows through the flame flash-back barrier 17 and a flow chamber 26 formed between the flame flash-back barrier 17 and the fabric membrane 16, and forms a flame matrix 27 on the burner side after leaving the fabric membrane 16. This flame matrix 27 comprises individual flames as well as support flames arranged therebetween, wherein the individual flames protrude from the support flame. The flame matrix 27 points, for example, into a combustion chamber of a boiler. Herein the burner can be operated according to EN676 "gas fan burner" on gas devices. Likewise, an operation is possible according to EN746-2 on thermoprocessing plants in the field of industry and business.

At least one ignition electrode 24 and at least one monitoring electrode 25 are arranged on an outer side of the housing 14 or of the burner head 12. Furthermore, on the outer side of the burner head 12, a boiler cover 20 is provided, with which an opening of the boiler which is not depicted in more detail and the combustion chamber thereof is able to be closed.

In FIG. 3, a schematic sectional view of the burner 11 along the line II-II in FIG. 2 is depicted. The housing 14 is formed to be tubular and has a receiving region 47 in which the fabric membrane 16 and flame flash-back barrier 17 are arranged. A flame tube 60 is connected integrally to a burner housing 61 and forms the housing 14. A spacer element 48 is preferably provided between the fabric membrane 16 and the flame flash-back barrier 17, with which the flame flash-back barrier 17 is provided at a predetermined axial distance from the fabric membrane 16.

The receiving space 47 in the housing 14 comprises an inner peripheral surface 49 which is limited on the burner side by a circulating shoulder which is preferably formed integrally on the housing 14. On the side of the fan, the inner peripheral surface 49 is limited by a groove 52. In the receiving region 47, the fabric membrane 16, the spacer element 48 and the flame flash-back barrier 17 are guided and positioned radially by the inner peripheral surface 49. Due to a releasable connection element 54 which is able to be inserted into the groove 52, the fabric membrane 16, the spacer element 48 and the flame flash-back barrier 17 are positioned and fixed with respect to the shoulder 51 in the receiving region 57. The releasable connection element 54 is, for example, formed as a clamping ring or circlip which is able to be inserted into the groove 52.

With this embodiment, the fabric membrane 16, the spacer element 48 and/or the flame flash-back barrier 17 are arranged in the housing 14 to be able to be exchanged individually. For the assembly, for example, the fabric membrane 16 is firstly inserted on the side of the fan, such that this abuts on the shoulder 51 with a burner-side surface and is fixed in the axial direction. A radial front surface of the fabric membrane 16 abuts on the inner peripheral surface 49, such that the fabric membrane 16 is guided radially in the receiving region 47 or is able to be rotated around the longitudinal central axis 37 of the housing 14. Following this, the spacer element 48 can be inserted, the outer peripheral surface of which also abuts on the inner peripheral surface 49 of the receiving region 27. Following this, the flame flash-back barrier 17 is inserted, which abuts on an axial front surface of the spacer element 48 with the front side which points towards the fabric membrane 16. The flame flash-back barrier 17 is also guided with its radial front side through the inner peripheral surface 49 in a radially rotatable manner with respect to the longitudinal central axis 37. Following this, the releasable connection element 54 is introduced into the receiving region 47 in the burner head 12 on the fan side and, for example, is positioned in a groove 52. Here, the fabric membrane 16, the spacer element 48 and the flame flash-back barrier 17 are positioned under low pre-tensioning with respect to one another and are pressed against the shoulder 51, such that a fixed-position arrangement of at least the fabric membrane 16 and the flame flash-back barrier 17 is provided in the receiving region 47 and is maintained by the releasable connection element 54.

The construction of the fabric membrane 16 emerges from DE 10 2010 051 415.2 which is referred to in its full scope and is the subject matter of this application. This burner fabric or this fabric membrane 16 enables a combustion process which is described in DE 10 2010 051 414.4, which is also referred to in its full scope and is the subject matter of this application.

The fabric membrane 16 has a hole pattern which comprises a plurality of through-holes 32 that are arranged at regular distances to one another. The flame flash-back barrier 17 likewise comprises a hole pattern having through-bores 33 which preferably have half the spacing of the through-holes 32 of the fabric membrane.

Due to the releasable connection element 54, an alignment of the hole pattern of the fabric membrane 16 with the hole pattern of the flame flash-back barrier 17 is enabled before the insertion of the releasable connection element 54, and due to the releasable connection element 54, a position fixing of the fabric membrane 16 and flame flash-back barrier 17 in the receiving region 47 with respect to one another is maintained after the alignment of the fabric membrane 16 to the flame flash-back barrier 17.

The housing 14 is formed integrally and is produced, for example, as a rotating part. The housing 14 is connected to a connection element 57 via a screw connection 56, which leads, for example, to the fan 19. This connection element 57 is, for example, formed as a bump turn. A connection plate 58 to receive and position the ignition electrode 24 and monitoring electrode 25 is provided on an outer side of the housing 14.

An alternative embodiment of the burner 11 to FIG. 3 is depicted in FIG. 4. The housing 14 in turn comprises a receiving space 47, which is limited by the shoulder 51 on the burner side. The fabric membrane 16, the spacer element 48 and the flame flash-back barrier 17 are arranged in the receiving space 57. Deviating from FIG. 3, the releasable connection element 54 is formed by a screw connection which divides the housing 14 into a burner housing 61 and a flame tube 60 which is able to be fixed thereon, wherein the shoulder 51 is arranged on the flame tube 60. The burner housing 61 has an external thread 62 which receives an internal thread of the flame tube 60. A front side of the burner housing 61 has a clamping surface 63, on which the flame flash-back barrier 17 is supported. By screwing the flame tube 60 to the burner housing 61, a bracing of the fabric membrane 16, of the spacer element 48 and of the flame flash-back barrier 17 with respect to one another or against the shoulder 51 occurs via the clamping surface 63, such that a pre-set alignment of the hole pattern of the fabric membrane 16 and the hole pattern of the flame flash-back barrier 17 with respect to each other is maintained. This arrangement likewise enables a simple assembly and disassembly, since the flame tube 60 of the housing 14 can be removed from the burner housing 61 in a simple manner due to the screwing together. Alternatively to this interior screw connection—so between the flame tube 60 and the burner housing 61—an exterior screw connection can also be provided, with which the flame tube 60 engages with the burner housing 61.

An elongation 70 can be provided between the burner housing 61 and the flame tube 60, which preferably also comprises a screw connection as a releasable connection element 54. The releasable connection element 54 can alternatively also be formed as a plug connection, a clamping connection or a flange connection.

The embodiments according to FIGS. 3 and 4 show the exemplary arrangement of the releasable connection element 54 on the side of the fan, meaning that the supplied fuel-air mixture firstly flows past the releasable connection element 54 before this mixture flows through the flame flash-back barrier 17, the flow chamber 26 and the fabric membrane 16 for the formation of the flame matrix 27.

A further alternative embodiment to FIG. 3 is depicted in FIG. 5. In this embodiment, two releasable connection elements 54 are provided, between which the receiving region 47 is formed. For example, two circlips or snap rings are provided as releasable connection elements 54 which limit the inner peripheral surface 49 to receive the fabric membrane 16, the spacer element 48 and the flame flash-back barrier 17 or apply a pre-tensioning to these components.

In this embodiment, a tube can be used as a housing 14 which requires only the attachment of two grooves 52 on the inner periphery in order to position and fix the fabric membrane 16 and the flame flash-back barrier 17 therebetween.

The housing 14 can consist of a drawn or rolled or welded sheet metal material which is heat-resistant.

In FIG. 6, a schematic side view, and in FIG. 7 a top view of an alternative embodiment of the burner 11 to FIG. 1 is depicted. Deviating from this, for example, the fan 19 is arranged directly on the supply 18 of the housing 14. The housing 14 of this burner 11 is, for example, formed from a tube, which is produced without machining instead of a machine processing according to the housing 14 in FIGS. 3 to 5. For example, a circulating beading is introduced into the housing 14 by forming, said beading forming the shoulder 51.

FIG. 8 shows such a detailed view according to the detail X in FIG. 6 in a schematically enlarged manner. For the positioning and fixing of the fabric membrane 16, the spacer element 48 and the flame flash-back barrier 17 to the shoulder 51, a circlip or a clamping clip is provided in this embodiment as a releasable connection element 54. During a fixing procedure, this circlip widens its outer periphery and is braced against the inner peripheral surface 49 of the housing 14. Due to the prior application of a contact pressure in the axial direction along the longitudinal central axis 37 and the subsequent bracing of the circlip, a pre-set alignment of the fabric membrane 16 and flame flash-back barrier 17 with respect to each other can in turn be fixed.

In this embodiment according to FIGS. 6 to 8, it is furthermore provided that the at least one ignition electrode 24 and at least one monitoring electrode 25 are arranged inside the housing 14. For this purpose, these are preferably received in a mutual retaining tube 66. The retaining tube 66 is formed to be tubular, which preferably comprises a coil 67 on the burner side, which abuts on a burner-side surface of the fabric membrane 16 and crosses a through-opening 68 in the fabric membrane 16. The retaining pipe 66 is fixed to a base 69 of the housing 14 on the fan side, in particular is braced by a screw connection. Due to this arrangement, the fabric membrane 16 is additionally supported and is held in a manner that is resistant to oscillation.

In FIG. 9, a detailed view of an alternative embodiment of the burner head 12 to FIG. 8 is depicted schematically. With regard to the arrangement of the fabric membrane 16, the spacer element 48 and the flame flash-back barrier 17 as well as the releasable connection element 54 and alternatives thereto, reference is made to the embodiment according to FIGS. 6 to 8 in their full scope.

In deviation from this, in this embodiment of the burner head 12 in comparison to the burner head 12 according to FIG. 8, instead of a beading as a circulating shoulder as an installation for the fabric membrane 16, a tube section 75 is provided, which comprises a smaller diameter than the housing 14 in the receiving region 47. This tube section 75 is partially inserted into an end section 76 of the tubular housing 14, which has a curve running towards the centre of the axis. The end section 76 abuts on the outer periphery of the tube section 75 and is preferably welded to the sealing point 77. Alternatively, a press connection or a circulating cuff can be provided in order to arrange this end section 76 for the flush and finalised installation on the tube section 75. Furthermore, a releasable connection can also be provided, such as, for example, a screw connection. At least one sealing element is preferably provided inside the housing 14 close to the sealing point 77, between the tube section 75 which projects inwards and the curved end section 76, in order to seal the circulating sealing point 77. This can be a welded seam. The interior end of the tube section 75 forms a shoulder 51, on which the fabric membrane 16 abuts.

These embodiments of the burner 11 according to FIGS. 8 and 9 comprise, for example, a diameter of, for example, greater than 260 mm. The previously described embodiments are preferably provided for burner surfaces with a diameter of up to 260 mm, wherein both the first and the other embodiment are able to be used for larger or smaller burner surfaces. The burner surface is understood to be the free surface of the fabric membrane 16 pointing into a combustion chamber, which is limited by the shoulder 51 or a burner-side connection element.

Furthermore, a distributor body 71 is provided in the housing 14, which has a conical or roof-like contour which is aligned to be pointing upstream. This distributor body 71 is fixed via retaining elements 72 at a distance to the base 69. An open jet of the fuel-gas mixture entering via the supply line 18 flows along the conical surfaces of the distributor body 71 radially outwards, whereby it causes a pressure and/or mixture distribution of the supplied fuel-air mixture to occur inside the housing 14, such that an even loading of the flame flash-back barrier 17 and the fabric membrane 16 is enabled.

The receiving space 47 in the above embodiments is preferably formed to be cylindrical, such that the fabric membrane 16 and the flame flash-back barrier 17 which are able to be arranged therein are able to be adjusted in their position with respect to one another in a simple way by rotation around the longitudinal central axis 37.

Due to the use of the at least one releasable connection element 54, not only can a cost reduction be achieved for the maintenance, but at the same time the reduction of the noise due to the formation of flame nests is also achieved, which is able to be adjusted with respect to an aligned arrangement of the hole patterns of the fabric membrane 16 and flame flash-back barrier 17 by a twisted arrangement of the hole pattern of the fabric membrane 16 with respect to the hole pattern of the flame flash-back barrier 17.

The invention claimed is:

1. A burner with surface burning, comprising:

a burner head having a housing; and a fan connected to the housing of the burner head, the fan being configured to generate a fuel-air mixture that is supplied to the burner head the burner head including:

a flow passage for the fuel-air mixture, wherein the flow passage has an inlet end and an outlet end, and the flow passage is connectable at the inlet end to a fuel-air mixture supply;

a fabric membrane at the outlet end of the flow passage, through which the fuel-air mixture exits at an outlet side of the fabric membrane, wherein the fabric membrane is configured to support a flame matrix at or adjacent to the outlet side of the fabric membrane; and a flame flash-back barrier upstream of the fabric membrane and spaced from the fabric membrane;

wherein the fabric membrane and the flame flash-back barrier are retained by at least one releasable connection element which engages with a receiving region in the housing;

wherein the fabric membrane has through-holes arranged in a hole pattern, which change their alignment in the housing, and the flame flash-back barrier has through-bores arranged in a hole pattern which is aligned in a position arranged with respect to the hole pattern of the fabric membrane, and the fabric membrane and the flame flash-back barrier are held to be braced in these positions which are aligned with respect to each other by the at least one releasable connection element.

2. The burner according to claim 1, wherein the housing is formed to be tubular and the receiving region comprises an inner peripheral surface, with which at least one of the fabric membrane and flame flash-back barrier are guided radially or laterally.

3. The burner according to claim 1, wherein at least one spacer element is arranged between the fabric membrane and the flame flash-back barrier.

4. The burner according to claim 1, wherein at least one releasable connection element is provided upstream of the flame flash-back barrier.

5. The burner according to claim 1, wherein the receiving region is limited downstream by an annular shoulder pointing towards the longitudinal central axis of the housing and upstream by the releasable connection element.

6. The burner according to claim 1, wherein the releasable connection element is formed by a screw connection which comprises a burner housing and a flame tube which engages therewith, which form the housing, and the flame tube comprises a shoulder.

7. The burner according to claim 6, wherein the flame flash-back barrier abuts on a clamping surface of the burner housing and the fabric membrane abuts on the shoulder and the burner housing is connected to the flame tube by a screw connection.

8. The burner according to claim 6, wherein at least the fabric membrane is fixed by the screw connection in the housing and the flame flash-back barrier is fixed by a releasable connection element.

9. The burner according to claim 1, wherein the at least one releasable connection element is provided in the housing upstream and downstream of the receiving region respectively.

10. The burner according to claim 5, wherein the housing is formed as a rotating part.

11. The burner according to claim 6, wherein at least one extension is arranged between the flame tube and the burner housing.

12. The burner according to claim 1, wherein the receiving region is formed downstream by a circulating beading which is formed with respect to the longitudinal central axis as a shoulder in the tubular housing or consists of two tube sections which are placed one inside the another.

13. The burner according to claim 12, wherein the receiving region consists of two tube sections, which are disposed one inside the other and are connected firmly to one another; and wherein an inner tube section of the two tube sections forms a shoulder.

14. The burner according to claim 1, wherein the releasable connection element is formed as a circlip or clamping ring which is inserted into a circulating groove in the housing.

15. The burner according to claim 1, wherein the releasable connection element is formed from an inner clamping ring which is braced by radial expansion with respect to the inner peripheral surface of the housing.

16. The burner according to claim 12, wherein the housing consists of a drawn or rolled or welded tube.

17. The burner according to claim 1, wherein the flame tube or the burner housing or both is produced as a casting made from grey cast iron or aluminium cast.

18. The burner according to claim 1, wherein the housing consists of a heat-resistant material, stainless steel or grey cast iron.

19. The burner according to claim 1, wherein at least one ignition electrode and at least one monitoring electrode are fixed to an outer side of the housing, the electrode tips of which extend into a flame matrix which is formed downstream on the fabric membrane or extend adjacently to this.

20. The burner according to claim 1, wherein a retaining tube is provided to receive at least one ignition electrode and at least one monitoring electrode, which is inserted into a through-opening in the fabric membrane and extends inside the housing.

21. A method of burning a fuel-air mixture at or adjacent to the outlet side of the fabric membrane of the burner of claim 1, wherein the method includes:

driving the fuel-air mixture via the fan and supplying the fuel-air mixture to the burner head via the fuel-air mixture supply, wherein the fuel-air mixture flows through the flame flash-back barrier and a flow chamber formed between the flame flash-back barrier and the fabric membrane; and forming a flame matrix at or adjacent to the outlet side of the fabric membrane after the fuel-air mixture exits the outlet side of the fabric membrane.

22. The burner according to claim 1, wherein the fan is upstream of the flame flash-back barrier and configured to drive the fuel-air mixture downstream through the flame flash-back barrier and the fabric membrane via the flow passage.

* * * * *